US007832164B2

(12) United States Patent
Gittleman

(10) Patent No.: US 7,832,164 B2
(45) Date of Patent: Nov. 16, 2010

(54) CONCEALED REINFORCEMENT MEMBER AND JOINT REINFORCEMENT SYSTEM FOR TRIM MOLDING

(76) Inventor: Scott Gittleman, 6770 Colby La., Bloomfield Hills, MI (US) 48301

( * ) Notice: Subject to any disclaimer, the term of this patent is extended or adjusted under 35 U.S.C. 154(b) by 261 days.

(21) Appl. No.: 12/079,109

(22) Filed: Mar. 25, 2008

(65) Prior Publication Data

US 2009/0241446 A1 Oct. 1, 2009

(51) Int. Cl.
*E04F 19/02* (2006.01)
*E04F 13/07* (2006.01)

(52) U.S. Cl. ..... 52/364; 52/718.01; 52/211

(58) Field of Classification Search ..... 52/211, 52/288.1, 717.01, 718.01, 656.9, 364, 506.1, 52/506.05, 507, 511; 403/401, 402
See application file for complete search history.

(56) References Cited

U.S. PATENT DOCUMENTS

| | | | | |
|---|---|---|---|---|
| 2,872,711 | A * | 2/1959 | Killebrew | 52/212 |
| 5,022,212 | A | 6/1991 | Lippolt | |
| 5,179,811 | A * | 1/1993 | Walker et al. | 52/288.1 |
| 5,210,986 | A * | 5/1993 | Hagemeyer et al. | 52/211 |
| 5,298,099 | A | 3/1994 | Hoffmann, Sr. | |
| 5,442,886 | A | 8/1995 | Iacobelli | |
| 5,620,768 | A | 4/1997 | Hoffmann, Sr. | |
| 5,839,241 | A | 11/1998 | Cacossa et al. | |
| 6,148,883 | A * | 11/2000 | Wilson | 144/344 |
| 6,360,503 | B1 * | 3/2002 | Koenig, Jr. | 52/287.1 |
| 6,447,872 | B1 | 9/2002 | Larson | |
| 6,952,904 | B2 | 10/2005 | Nickel | |
| D529,193 | S | 9/2006 | Mucci | |
| 2003/0029121 | A1 * | 2/2003 | Nickel | 52/698 |
| 2006/0191237 | A1 | 8/2006 | Hansen | |
| 2006/0283115 | A1 | 12/2006 | Robertson | |
| 2007/0175123 | A1 * | 8/2007 | Bernier et al. | 52/211 |
| 2007/0234661 | A1 * | 10/2007 | Vaes | 52/287.1 |

OTHER PUBLICATIONS

Alibaba.com—Anping County Tengfei Mish Co. Ltd., Punching Hold Mesh, Aug. 13, 2007, 2 pages.
Alibaba.com—Suzhou Everich Imp. & Exp. Co., Ltd. Drywall Mesh, Sanding Screen, Aug. 13, 2007, 3 pages.
Alibaba.com—Shijiazhuang Chenhui Xingye Industry and Trade Co., Ltd., External Wall Insulation Alkali Mesh, Aug. 13, 2007, 2 pages.
Alibaba.com—Ningbo Shanquan Fiberglass Co., Ltd., Wall Reinforced Mesh, Aug. 13, 2007, 3 pages.
Alibaba.com—Changshu Jiangnan Glass Fiber Co., Ltd., Alkali Resistant Mesh for Inner Wall, Aug. 13, 2007, 3 pages.

* cited by examiner

*Primary Examiner*—David Dunn
*Assistant Examiner*—Christine T Cajilig
(74) *Attorney, Agent, or Firm*—Reising Ethington P.C.

(57) ABSTRACT

A joint support system for trim members 12 and 14 has a reinforcement member 16 attached to the trim members 12 and 14. A fastener fastens the trim members 12 and 14 to the reinforcement. An adhering glue may be applied and set between the reinforcement member 16 and trim members 12 and 14 to form a tight joint.

8 Claims, 2 Drawing Sheets

CONCEALED REINFORCEMENT MEMBER AND JOINT REINFORCEMENT SYSTEM FOR TRIM MOLDING

TECHNICAL FIELD

The field of this invention relates to trim molding for housing construction and a system for supporting a tight joint between trim members.

BACKGROUND OF THE DISCLOSURE

One important aspect for making new housing construction or a remodeling project appear well built and add value to a home, condo or other building is the trim molding. Trim molding may be placed about various places within a building including door and window frames as well as around upper edges between walls and ceilings. Other decorative trim moldings such as chair moldings also dress a building to be attractive.

Often trim molding is made from a plurality of separate trim members that are connected together at a tight joint to form a continuous looking unitary member. The trim can often be shellacked, or painted to further hide and conceal the joint. A poorly installed trim molding that forms a gap within the joint is detractive and undesirable.

A problem with many installed trim moldings is that while they are often assembled correctly with tight joints that is either invisible or barely noticeable, after the elapse of time, settling of the new underlying construction will often pull apart the joint and form a crack in the paint coating or otherwise make the make the joint noticeably visible with a large unsightly gap. Older settled buildings often have quite large and noticeably unsightly gaps between trim members. While extra nails and screws can secure a joint, the nails and screws are either undesirably exposed or require wood putty to conceal them. The extra wood putty is also undesirable because it does not take stain well or it dries up and pops out.

The settling and gapping of the trim joint is exacerbated by the common interposition of drywall between the trim member and a supporting stud member or the like. Drywall is not a structural support member. Thus, the spacing of the trim member from the supporting stud member due to the interposition of drywall reduces the lateral rigidity provided by the nail. In other words, the long extension of the nail from the trim member through the drywall and to the stud member reduces the lateral rigidity provided by the nail.

What is needed is a concealed trim molding system that retains tight trim joints together and resists separation of the trim members. What is also needed is a system that secures the trim members together on the exterior side of any drywall.

SUMMARY OF THE DISCLOSURE

In accordance with one aspect of the invention, a joint reinforcement system mounts two trim members together to a supporting substrate. The joint reinforcement system includes a substrate and a reinforcement member being mounted to the substrate. Two trim members are mounted to abut each other to form a joint with each trim member positioned over a portion of the reinforcement member. The trim members are preferably adheredly mounted to the reinforcement member. A respective fastener pierces the respective trim members and extends through the reinforcement member and engages the substrate.

Often a layer of drywall may be interposed between the substrate and the reinforcement member. The reinforcement member is at the exterior side of any drywall and is in close proximity of the trim member. Preferably, the reinforcement member is mesh like with a plurality of perforations therethrough.

The reinforcement member may be made from metal. Preferably, the reinforcement member can be made from an aluminum sheet. The reinforcement member may have a substantially planar section.

Alternatively, the reinforcement member is bent with two substantially transverse planar sections to have trim members positioned substantially at right angles with respect to each other and secured to the respective transverse planar sections. The trim members may be a side trim member and upper trim member for a door or window opening.

BRIEF DESCRIPTION OF THE DRAWINGS

Reference now is made to the accompanying drawings in which.

DETAILED DESCRIPTION OF THE PREFERRED EMBODIMENT

Figure 4:
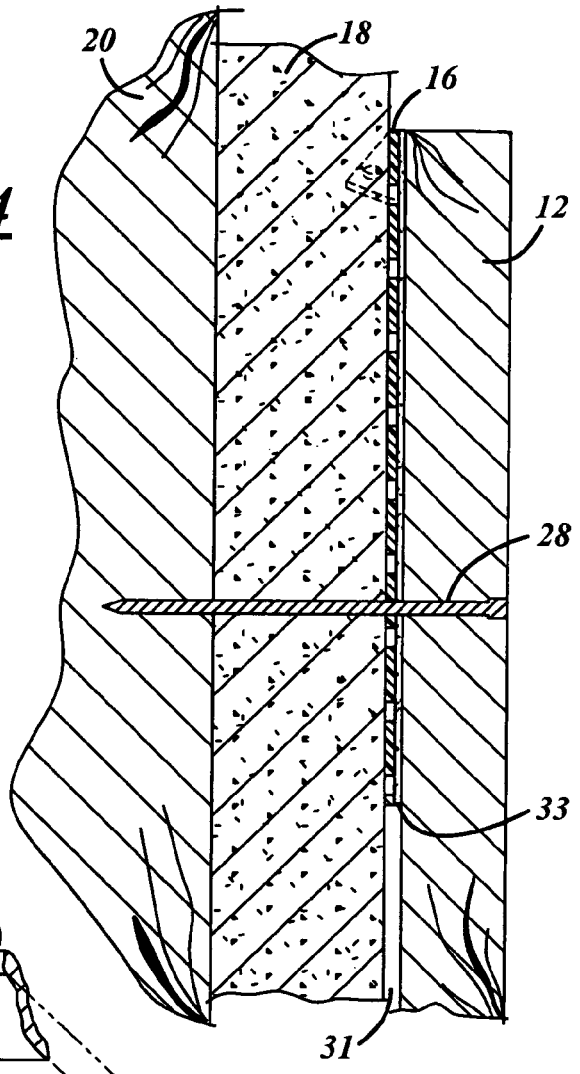
FIG. 4 is a cross section view taken along lines 4-4 shown in FIG. 1.

Referring now to FIGS. 1-4, a trim molding assembly 10 has two trim members 12 and 14 connected to a reinforcement member 16 which are all connected to a substrate, for example drywall 18 and other structural underlying members such as a stud 20 or jamb 21 (as shown in FIG. 4). Each trim member 12 and 14 are appropriately cut to provide a tight joint 22. The reinforcement member 16 is positioned or the exterior side of the drywall 18 to span under both trim members 12 and 14. By "exterior side", it is meant the side that is opposite from the one facing the interior hidden section of wall. The shape of the reinforcement member 16 can be varied depending on the configuration of the trim molding. A typical shape can be a planar L-shape for trim members 12 and 14 that are abutted to each other at the top and side of a typical door or window opening 19.

The reinforcement member 16 is a thin member that has rigidity against stretching along its main plane. In one preferred embodiment, it is foreseen that the member 16 can be made from a sheet of perforated aluminum that may have a thickness ranging from 1/64 to 1/32 to provide the sufficient rigidity but still allow a nail to be hammered therethrough by manual force. The sheet can be perforated with a plurality of apertures 30. The apertures 30 may have a size for example to receive a finishing nail 32. As shown more clearly in FIGS. 2 and 4, the reinforcement member 16 has two bent corner tabs 24 that are bent substantially perpendicular to the main planar section 25 for tacking into dry wall 18.

Figure 1:
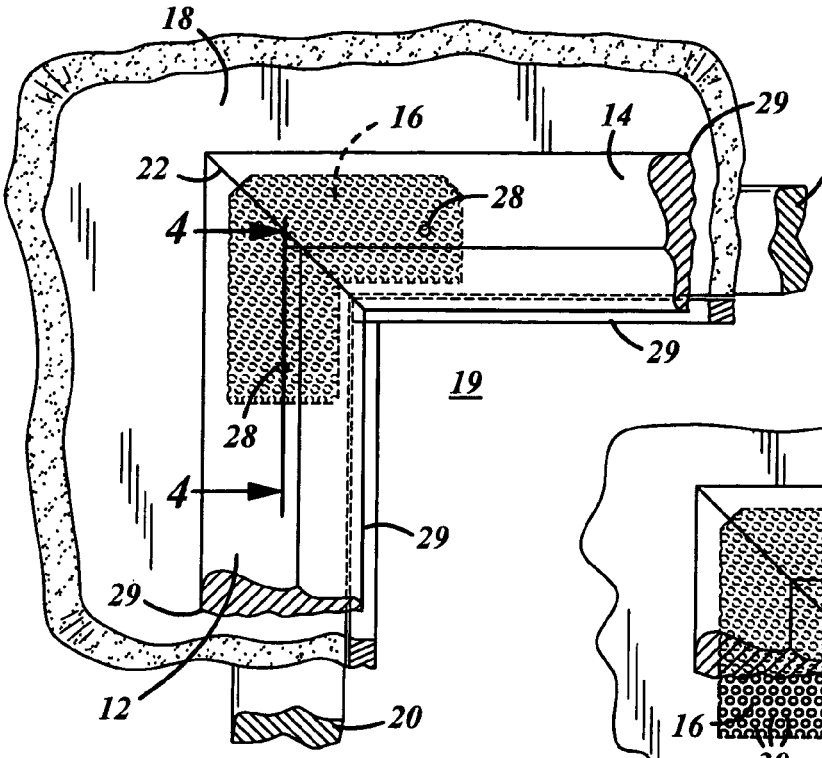
FIG. 1 is a front plan fragmentary view of an assembled trim assembly according to one embodiment of the invention.
Figure 3:
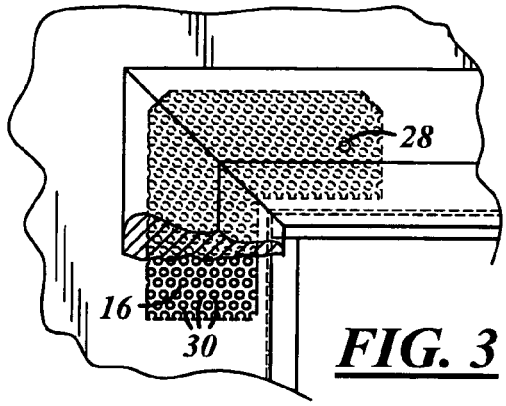
FIG. 3 is a fragmentary view similar to FIG. 1 with a trim member partially broken away to expose a portion of the reinforcement member.
Figure 2:
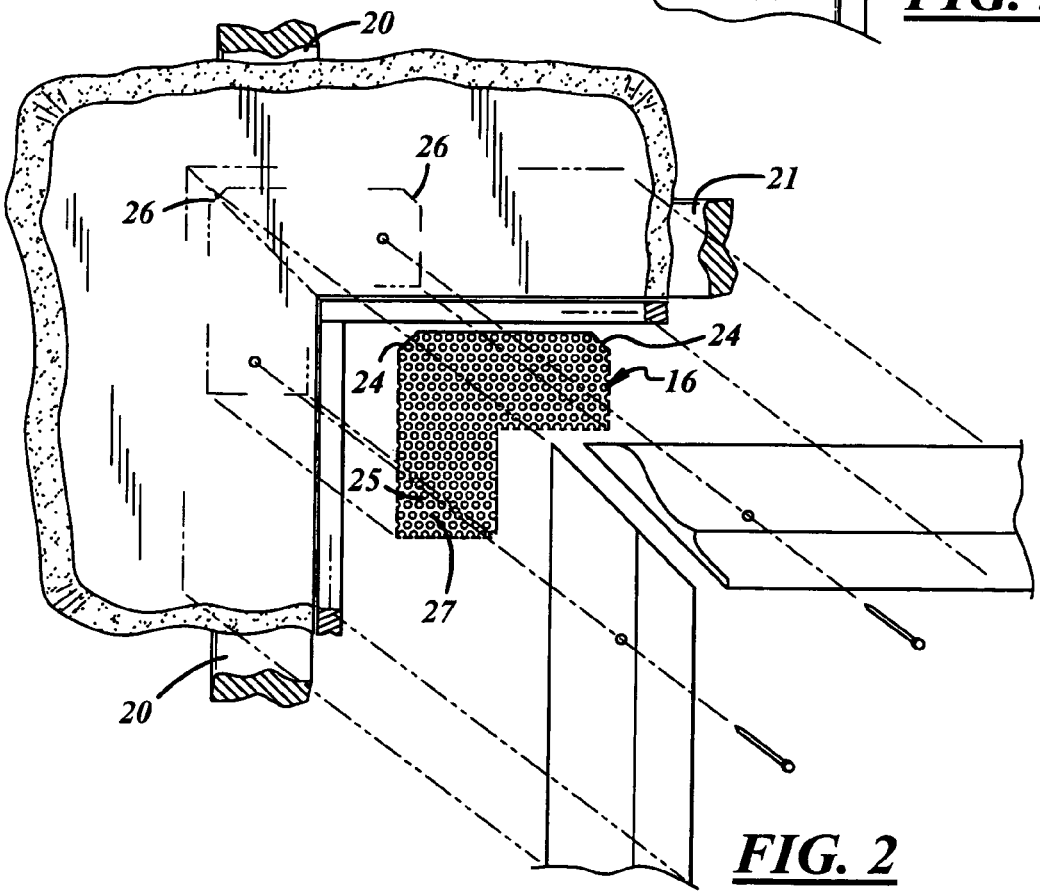
FIG. 2 is an exploded view of the trim assembly shown in FIG. 1.

Installation of the trim joint 22 begins with tacking the corner tabs 24 of the reinforcement member 16 into the exterior side of dry wall 18 at positions 26 indicated in FIG. 2. The member 16 has its main planar section 25 abut against the dry wall 18. A layer of glue 33 suitable for wood and aluminum is then applied to the backside of each trim member 12 and 14 and the trim members are then pressed onto the reinforcement member 16. As the trim member is pressed onto the reinforcement member, the glue makes contact with the planar outer face 27 of the reinforcement member 16 as well as intruding into the apertures 30. A finishing nail 28 is then driven through a respective trim member 12, 14, the reinforcement member 16, the dry wall 18, and the underlying stud 20 or jamb 21 as shown in FIG. 4.

After the glue sets with the set glue in the apertures 30 and bonding the reinforcement member 16 to each trim member 12 and 14, the set joint 22 becomes resistant against relative movement in any direction that may cause separation of the trim members 12 and 14. Caulk may then be conventionally applied to the inner and outer edges 29 between the trim members 12 and 14 and the dry wall 18 to conceal any gap 31 as shown in FIG. 4 and conceal the reinforcement member 16. By having many apertures, the surface available for adhesion is greatly increased.

Figure 5:
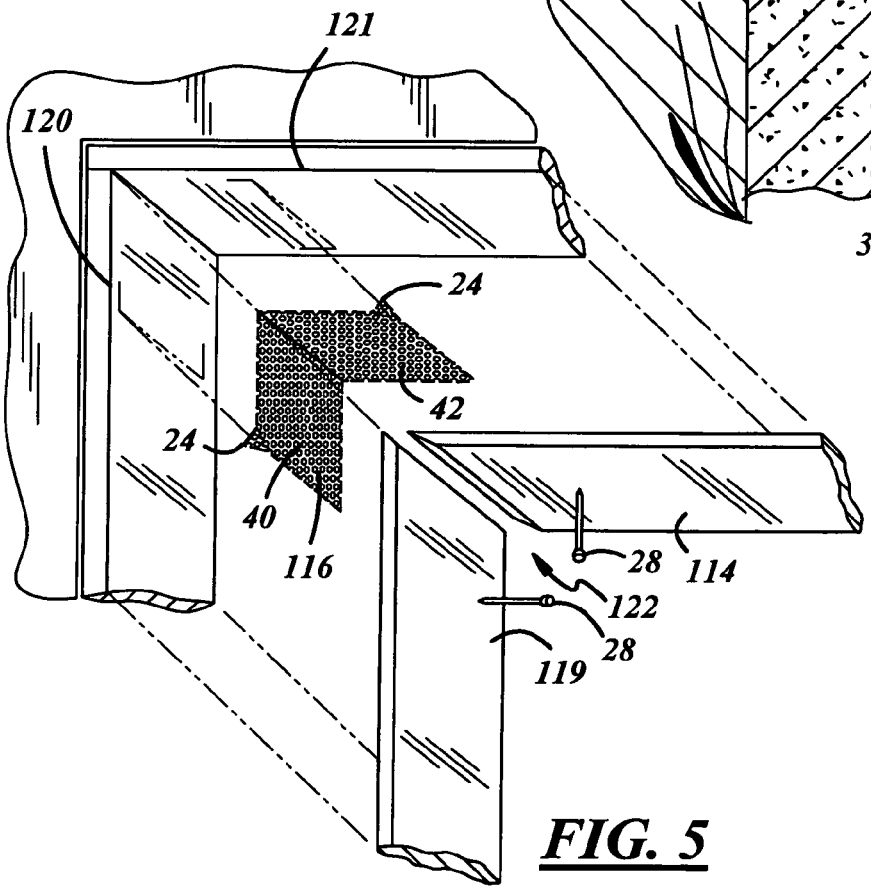
FIG. 5 is view of another embodiment of the invention showing an exploded view of installation of interior trim molding for example for covering a window jamb.

Another embodiment is shown in FIG. 5 where the reinforcement member 116 has two planar sections 40 and 42 that are substantially perpendicular to each other. The planar sections 40 and 42 each have one bent corner tab 24 being substantially perpendicular thereto. The corner tabs 24 are used to tack onto the jambs 120 and 121 where planar section 40 substantially abuts side jamb 120 and planar section 42 abuts header jamb member 121. Trim members 112 and 114 then have their back sides glued and pressed against the respective planar sections 40 and 42. Finishing nails 28 are then hammered in place to pierce respective trim members 112, 114, planar section 40 and 42 and jambs 120 and 121. The completed and formed joint 122 will remain tight and resistant to gapping after the glue is cured.

The substrate member may have other shapes for custom trim installations. It can also be used for base trim members to prevent pull down of the base relative to side trim members or between two base trim members for wide door entrances where two base trim members are used.

The reinforcement member 16 and 116 by being in close proximity to the trim members and being positioned on the exterior side of the drywall in proximity to the trim members adds lateral rigidity to the trim member. Furthermore, the large area of adhesion provided by the mark planar reinforcement member provides strong support against any direction perpendicular to lateral motion. Thus, an improved joint resistant against relative movement in any direction is provided. The retention of this tight joint is particularly advantageous if the joint is painted or shellacked. The paint or shellac after it is applied and dried has a greater chance of not cracking which is common at conventionally constructed joints.

Other variations and modifications are possible without departing from the scope and spirit of the present invention as defined by the appended claims.

The embodiments in which an exclusive property or privilege is claimed are defined as follows:

1. A joint reinforcement system for mounting two pieces of trim together to a substrate; said joint reinforcement system comprising:

a substrate;

a reinforcement member being mounted to a front side of said substrate;

a plurality of trim members mounted to abut each other to form a joint with each trim member positioned over a portion of said reinforcement member;

said trim members adheredly mounted to said reinforcement member;

a respective fastener piercing said respective trim members and extending through said reinforcement member and engaging said substrate;

said reinforcement member being a sheet that is relatively rigid and having substantially planar surfaces;

said sheet being interposed between the substrate and the trim members;

said trim members being in direct contact with said sheet; and said sheet having a plurality of perforations therethrough for receiving an adherent for mounting said trim members.

2. A joint reinforcement system as defined in claim 1 further comprising:

said reinforcement member being made from an aluminum sheet that has a plurality of circular perforations therethrough.

3. A joint reinforcement system as defined in claim 1 further comprising:

said sheet being generally L-shaped; and said trim members being a side trim member and upper trim member for a door or window opening.

4. A joint reinforcement system as defined in claim 3 further comprising:

said sheet being bent with two substantially transverse planar sections to have trim members substantially at right angles with respect to each other.

5. A joint reinforcement system as defined in claim 1 further comprising:

said sheet being made of metal that has a plurality of perforations therethrough.

6. A joint reinforcement system as defined in claim 1 further comprising:

a layer of drywall being interposed between said substrate and said sheet.

7. A joint reinforcement system as defined in claim 4 further comprising:

said trim members and said sheet being sized such that said sheet is completely concealed behind said trim members.

8. A joint reinforcement system as defined in claim 1 further comprising:

said trim members and said sheet being sized such that said sheet is completely concealed behind said trim members.

* * * * *